United States Patent [19]

Kleefeldt et al.

[11] 4,357,815

[45] Nov. 9, 1982

[54] LOCKS FOR VEHICULAR ANTITHEFT LOCK SYSTEM

[75] Inventors: Frank Kleefeldt, Heiligenhaus; Horst Brackmann, Velbert, both of Fed. Rep. of Germany

[73] Assignee: Kiekert GmbH & Co. Kommanditgesellschaft, Velbert, Fed. Rep. of Germany

[21] Appl. No.: 173,452

[22] Filed: Jul. 30, 1980

[30] Foreign Application Priority Data

Sep. 8, 1979 [DE] Fed. Rep. of Germany ..... 2936402

[51] Int. Cl.[3] ..... E05B 15/14; E05B 19/06; E05B 29/06; E05B 35/08

[52] U.S. Cl. ..... 70/337; 70/364 R; 70/377; 70/409

[58] Field of Search ..... 70/337, 340, 364 R, 70/409, 376, 377

[56] References Cited

U.S. PATENT DOCUMENTS 3,555,859 1/1971 Berkowitz ..... 70/340

FOREIGN PATENT DOCUMENTS 1296552 5/1962 France ..... 70/364 R

*Primary Examiner*—Robert L. Wolfe

*Attorney, Agent, or Firm*—Karl F. Ross

[57] ABSTRACT

A lock assembly has a tubular secondary lock housing having an inner wall generally centered on an axis and formed with an axially extending and inwardly open groove. A core plug is rotatable in this housing and has a central axially extending and open key-receiving passage. Axially spaced tumblers are exposed at this passage in the plug and are diametrally displaceable therein along a diametral plane between outer positions projecting radially beyond the outer surface and inner positions lying radially within the outer surface. These tumblers are only displaceable into the outer positions when they are radially aligned with the groove and when they are in the outer position and engaged in the groove they block the core from rotating in the housing. The tumblers have respective control edges subdivided at the diametral plane into first edge regions and second edge regions which are out of line with each other. First and second differently bitted keys are engageable in the passage with the control edges of the tumblers. The first key has first bits engageable only with the first regions of the tumbler when the first key is in the passage and the second key is similarly only engageable with the second regions of the tumblers. The bits and regions are so constructed that, even though the keys are completely differently bitted, either one can displace the tumblers into the inner position for operation of the lock.

10 Claims, 14 Drawing Figures

LOCKS FOR VEHICULAR ANTITHEFT LOCK SYSTEM

FIELD OF THE INVENTION

The present invention relates to locks. More particularly this invention concerns locks for use in a motor vehicle whose latches can be secured in a so-called antitheft position.

BACKGROUND OF THE INVENTION

A central vehicle door-lock system of the type described in commonly owned patent applications 132,977 and 132,978 both filed Mar. 24, 1980 has several door latches each including a detent movable between a locked position securing the door when closed and an unlocked position allowing the door to be opened by means of a mechanism inside the door latch. Each of these latches is associated with a servoactuator having an actuator that is engageable via this mechanism with the respective detent that is in turn moved by an operator. This operator, therefore, can move the actuator and with it the latch detent between a locked and unlocked position and the operator itself is movable by a servomotor into an antitheft position. A lock pawl on this actuator can, in the locked position of the actuator and in the antitheft position of the operator, move from a freeing position permitting displacement of the actuator from the locked to the unlocked position and into a blocking position preventing such displacement to lock up the entire latch. The servomotors are all controlled by a central switch which can operate them all jointly between the locked, unlocked, and antitheft positions. Thus when the switch is in the antitheft position the mechanism of the latches cannot displace the detent into the respective unlocked positions.

Such an arrangement has been found to be an extremely good security precaution, as it allows all of the door latches to be locked in such a manner that even a person having a key or access to the unlock button of one of the door latches cannot open this latch. The latches can only be moved into the unlocked position when the mechanism has been displaced out of the antitheft position.

To this end it has been normal practice simply to provide a separate three-position switch that controls these functions. The key to this switch has normally remained independent of the regular door-latch keys. Thus it is possible for the owner of a vehicle thus equipped to leave the ignition and door key with another, and yet know that only he himself has the key capable of operating the antitheft mechanism, so that if the door-ignition key falls into the wrong hands the owner can still lock up the vehicle.

In order to avoid the necessity of having an extra key, a double-duty lock has been suggested for operation of the driver's door lock. Thus the driver can, simply by operating his own door lock with a special key, lock all of the door latches and displace their mechanisms into the antitheft position.

This double-duty lock assembly is, however, relatively complex. It is normally necessary to provide two separate sets of tumblers in a two-part core. The outer, central part of the core has one set of tumblers which engage in a sleeve formed on the inner core part and carries the other set of tumblers. The standard door and ignition key can operate the outer core part and displace same between the locked and unlocked positions. Only a special key, however, can reach all the way into the inner core part and actuate its tumblers to displace the lock into the antitheft position.

Such a system is advantageous in that the operator of the vehicle can retain the key that operates the antitheft mechanism and, if necessary, give out other keys that operate the other systems. Nonetheless such lock assemblies have proven extremely complex. They must be made very carefully, as any failure to stay within very close tolerances will normally have a cumulative effect so that the lock will not operate. What is more, such a lock is relatively long so that mounting it in the motor-vehicle door becomes a problem, in particular when window mechanism must be allowed for. The cost of making such a lock is also relatively high, and the key must normally be a special extra-long key. Finally all of the other door locks in the car must be so constructed that they can accept this extra-long key, again raising the cost of the system incorporating such a lock.

OBJECTS OF THE INVENTION

It is therefore an object of the present invention to provide improved locks usable in an arrangement such as described in the above-cited copending applications, whose entire disclosures are hereby incorporated by reference.

Another object is to provide a lock which can be made of substantially the same size as a conventional lock, yet which nonetheless can be operated both by the standard lock key and the special-duty antitheft key.

Another object is to provide a lock which can be operated by two differently bitted keys that are otherwise indistinguishable from standard keys.

SUMMARY OF THE INVENTION

These objects are attained according to this invention in a lock assembly comprising a tubular secondary-lock housing having an inner wall generally centered on an axis and formed with an axially extending and inwardly open groove and a core plug in the housing having an outer surface closely radially juxtaposed with this inner wall and a central axially extending and open key-receiving passage. This plug is rotatable in the housing about the axis and carries a plurality of axially spaced tumblers exposed at the passage and diametrally displaceable therein along a diametral plane between outer positions projecting radially beyond the outer surface and inner positions lying radially within this outer surface. The tumblers are displaceable into the outer positions when radially aligned with the groove and the core is blocked from rotating in the housing when the tumblers are engaged in the outer positions in this groove. These tumblers have respective control edges subdivided at the diametral plane into first edge regions and second edge regions and at least some of the first edge regions are out of line with the respective second edge regions. First and second differently bitted keys are engageable in the passage with the control edges of the tumblers. The first keys have first bits engageable only with the first regions of the tumbler when the first key is in the passage and the second key is similarly provided with second bits engageable only with the second regions of the tumblers when the second key is in the passage. The bits and regions are so constructed and adapted that when either of the keys is fully engaged in the passage with their respective bits engaging the respective regions the tumblers are in the inner positions.

Thus without using complex split tumblers, as is known in master-key systems, it is possible for a single relatively simple lock mechanism to be operated by two completely differently bitted keys. The same tumblers will be displaced in the same manner by both keys, and both of the keys can be of the same axial length. In fact the only difference between the two keys is that the one will be, as seen in end view, a mirror image of the other, as its bits must lie to the other side of the above-described central plane in order to act on the respective regions of the control edges of the tumblers. Plate tumblers having central apertures forming the control edges are employed according to this invention.

This particular lock assembly is particularly usable in combination with a main-lock assembly according to and has separate sets of first and second tumblers. The housing of this main-lock assembly has at least one inwardly open first recess formed in the inner wall in radial alignment with the first tumblers only in one end position of the plug, which is displaceable from this one end position through an intermediate end position to another end position. These first tumblers engage in the first recess when in the outer position and thereby prevent angular displacement of the plug from the one end position when the first tumblers are in the outer position. At least one inwardly open second recess is also formed in the inner wall of the housing of the main-lock assembly in radial alignment with the second tumblers only in and between the one end position and the intermediate position of the plug. The second tumblers engage in the second recess only in and between the one end position and the intermediate position when in their outer position and thereby prevent angular displacement of the plug into the other end position with the second tumblers in the outer positions. Thus the plug can be turned between the one end and intermediate positions with the first key but can only be turned into the other end position with the second key. In effect the second tumblers permit displacement of the core plug between the one end position—normally the unlocked position—and the intermediate position—normally the locked position—but prevent displacement into the other end position—normally the antitheft position—unless they are acted upon by the second key.

It is therefore possible for the owner of a motor vehicle equipped with such a sophisticated antitheft system to use the main antitheft key just like a normal key in any of the car door locks or in the ignition, yet to have the capacity with this key to place the central lock system of the vehicle in the antitheft position. Other keys which can equally operate the ignition and various door locks cannot place the system into the antitheft position or, indeed, switch it out of the antitheft position. Thus even if a secondary key falls into the hands of a car thief, it will be impossible for this car thief to enter the vehicle if the owner has placed the central lock system in the antitheft position.

According to this invention the core plug is formed with a plurality of transversely throughgoing passages that cross the axially extending passage and that each contain at least one tumbler. Normally alternate tumblers are biased in opposite directions by their respective springs and the lock housing is formed with a pair of diametrally opposite grooves into which the ends are engageable. In this manner the core is solidly locked against rotation.

It is also possible according to this invention to provide two such tumblers in each of the transverse passages, one biased in one diametral direction and the other in the opposite diametral direction. Such an arrangement not only makes forcibly rotating the core in the housing extremely difficult, but also makes picking the lock virtually impossible.

The plate tumblers according to this invention have central apertures that are normally aligned with the axial passage of the lock. The control edge is formed on the side of this aperture turned away from the outer end of the tumbler, that is from the end that projects out of the core to lock the core in the housing. This control edge, according to this invention, is stepped at the above-described plane.

SPECIFIC DESCRIPTION

Figure 1:
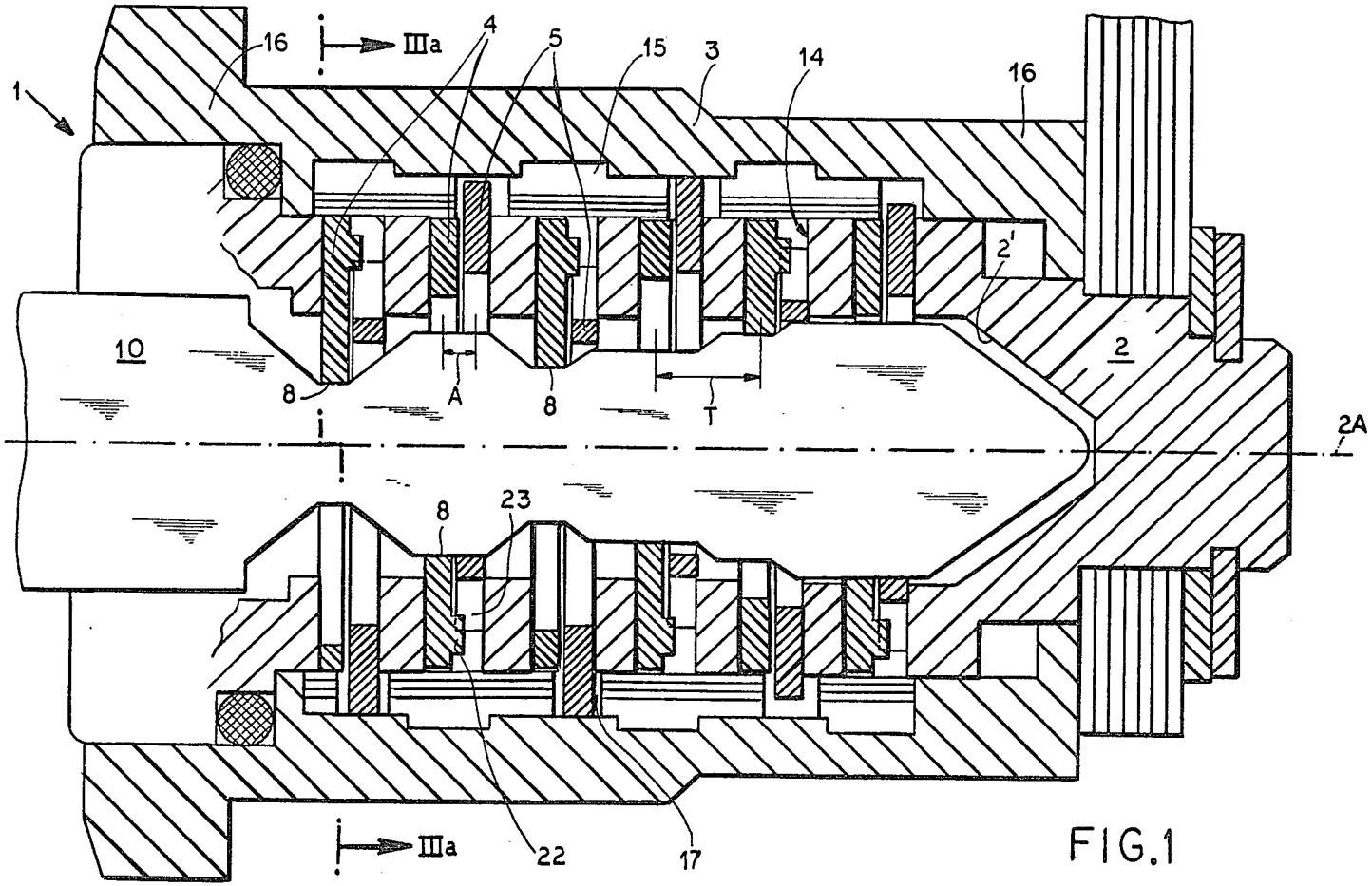
FIG. 1 is an axial section through the driver-door lock according to this invention with the lock key in place.
Figure 2:
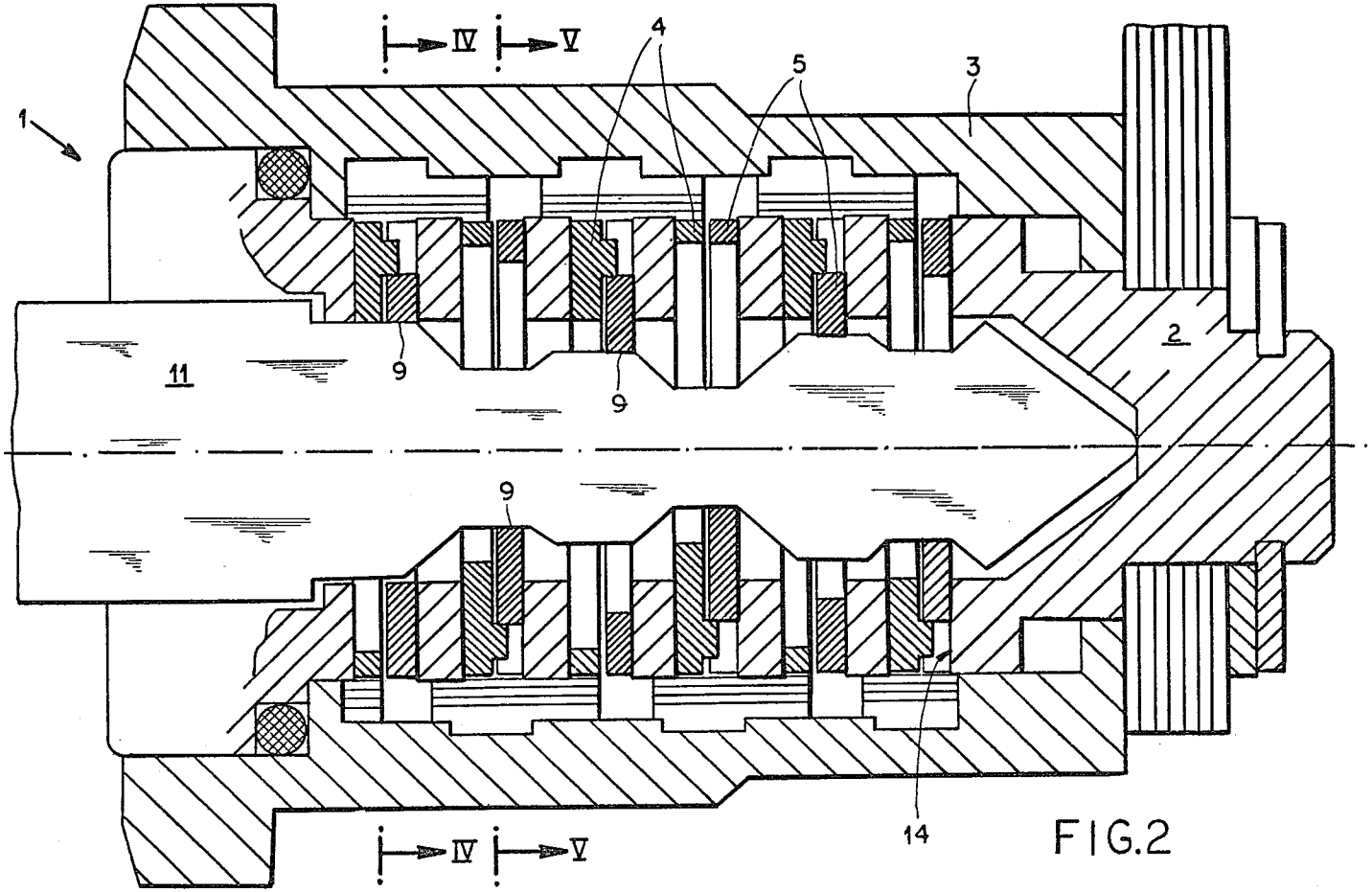
FIG. 2 is an identical axial section but with the antitheft key in place.
Figure 6:
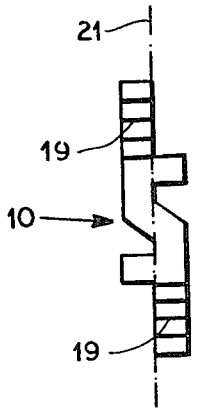
FIGS. 6 and 7 are end views of the lock and antitheft keys, respectively, according to the instant invention.
Figure 7:
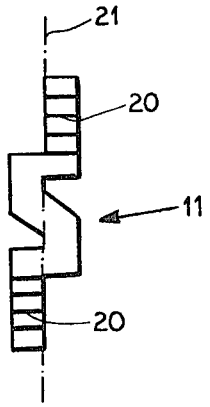

As seen in FIGS. 1 and 2 a driver's-door lock 1 has a core 2 rotatable about a core axis 2A inside a cylindrical housing or cylinder 3. Radially displaceable in the core 2 are lock plate tumblers 4 and antitheft plate tumblers 5 having respective central apertures 6 and 7 formed as also seen in FIGS. 3*a*–5 with respective control edges 8 and 9. Either a lock key 10 shown in FIG. 1 and in end view of FIG. 6 or an antitheft key 11 shown in FIG. 2 and in end view of FIG. 7 can operate this lock 2, with the lock key 10 only being engageable with the control edges 8 and the key 11 only with the control edges 9.

In a manner known per se these plate tumblers 4 and 5 are urged into radial outer positions by respective springs 12 and 13, with three of the lock tumblers and of the antitheft tumblers urged radially in one direction and the other three lock tumblers and other three plate tumblers being urged radially in the opposite direction, as the keys 10 and 11 are double-bitted. To this end the core 2 is formed with six transversely throughgoing passages forming guides 14 that cross the central key-receiving passage 2' formed in the core 2. Thus the overall length of the lock need not exceed that of a standard six-bit lock. The tumblers 4 are each spaced on centers from the adjacent tumblers 5 by a relatively short distance A, and the pairs of tumblers are spaced along the axis 2A by a standard distance indicated at T in FIG. 1. In fact the system is so very compact that it can even take the place of a standard six-bit cylinder.

Figure 3A:
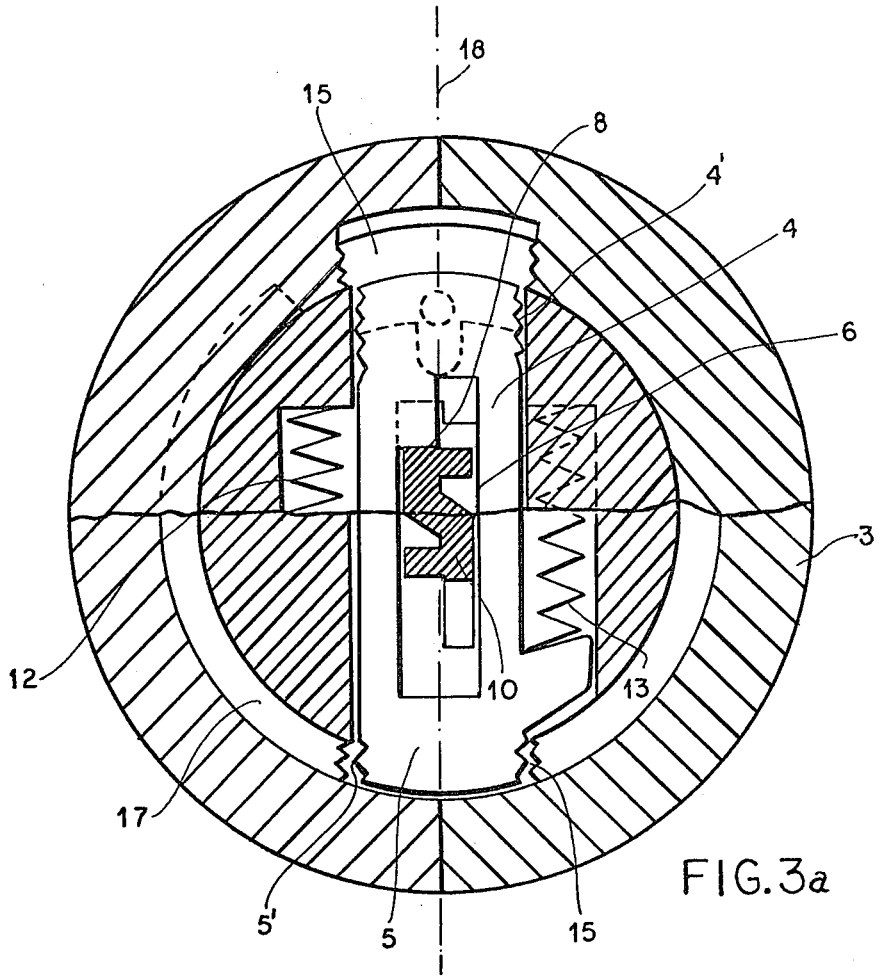
FIG. 3*a* is a section taken along line III*a*—III*a* of FIG. 1.
Figure 3C:
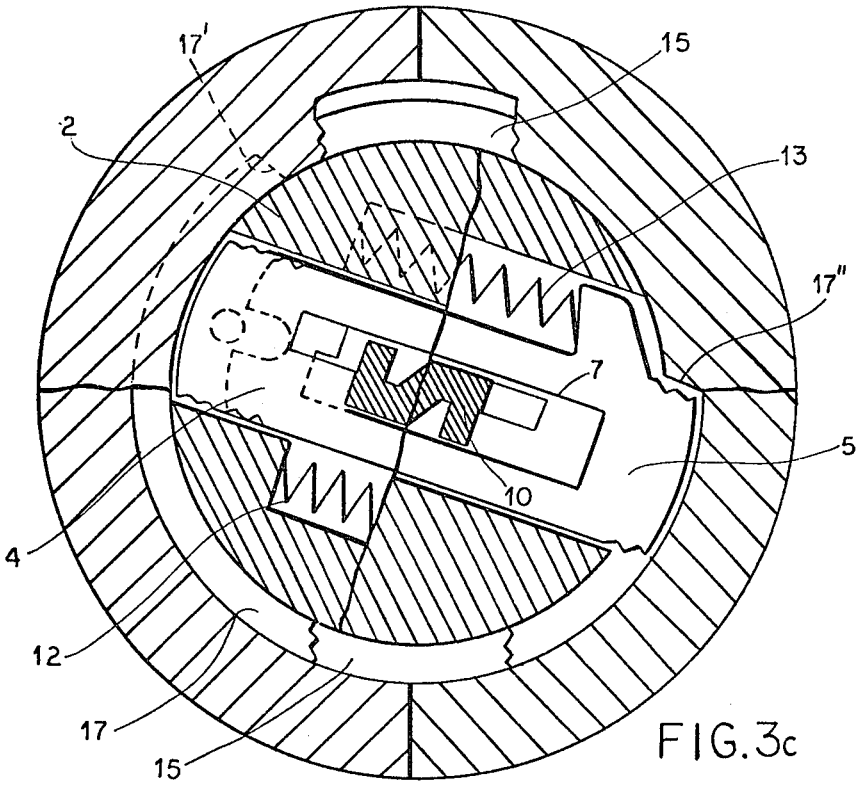
FIGS. 3*b* and 3*c* are views similar to FIG. 1 but showing the lock in two other positions.
Figure 3B:
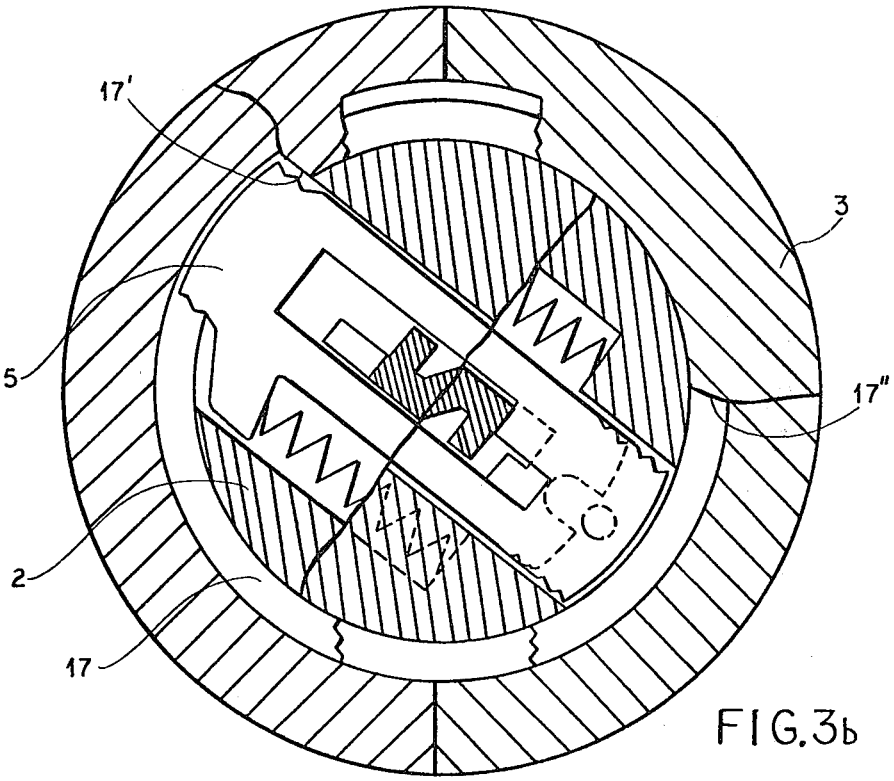
Figure 4:
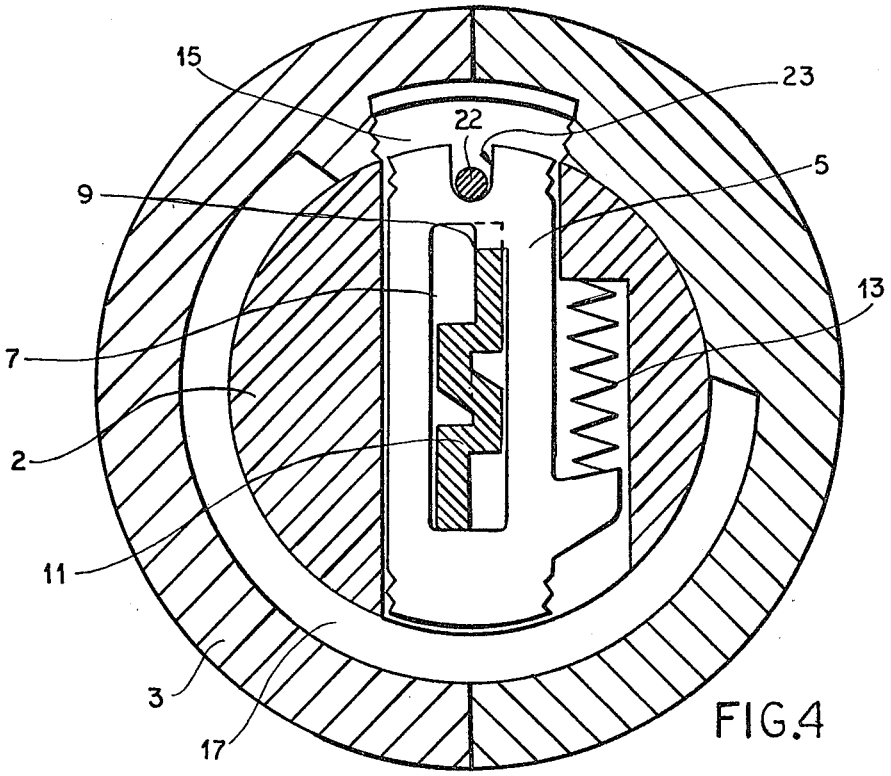
FIGS. 4 and 5 are sections taken along lines IV—IV and V—V of FIG. 2.
Figure 5:
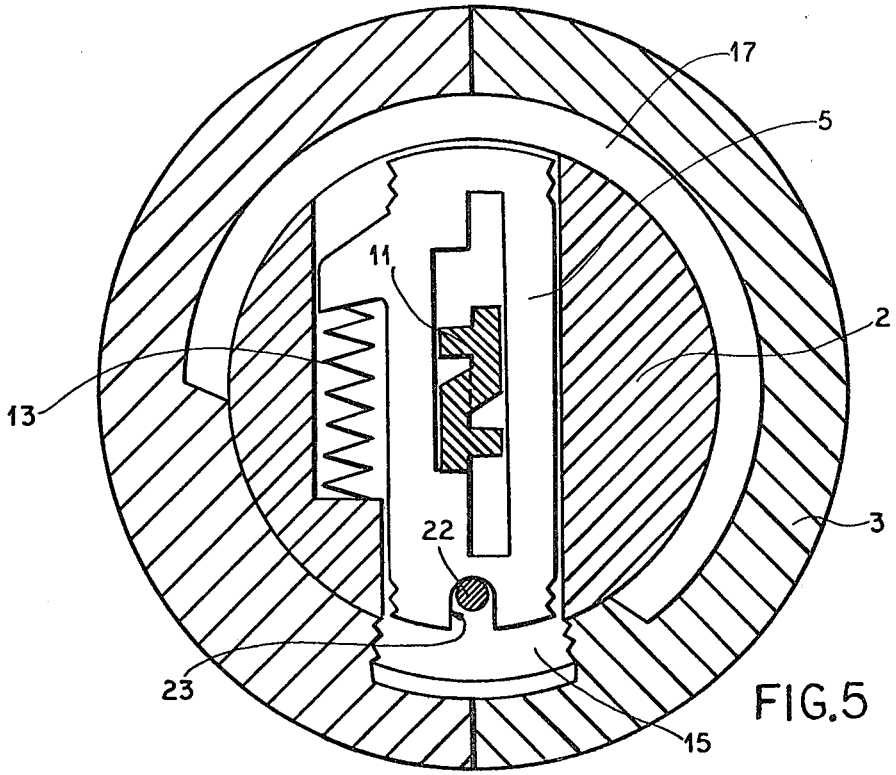

The cylindrical housing 3 for the core 2 is formed with a pair of diametrially opposite and axially extending grooves 15 in which the other ends of the tumblers 4 engage in the position shown in FIG. 3*a* as well as in FIGS. 4 and 5, a position which in this embodiment is actually a central starting position lying between the lock and unlock positions shown respectively in FIGS. 3*b* and 3*c*. The housing 3 is formed with a cylindrical journal surface 16 adjacent one end of the passage 2' for such rotation of the core 2 about the axis 2A.

These end positions are defined by angularly extending and inwardly open grooves 17 each aligned with the outer end of a respective one of the antitheft tumblers 5. When these tumblers 5 are in their projecting or outer positions as shown in FIGS. 3*b* and 3*c* they can move from the starting position shown in FIG. 3*a*, which is the only position in which a key cn be inserted into or withdrawn from the passage 2', either approximately 130° clockwise into the lock position of FIG. 3*b* or approximately 70° counterclockwise into the unlock position of FIG. 3*c*. In the former position the ends of the tumblers engage ends 17' of the respective grooves 17 and in the latter they engage ends 17'' of the grooves 17. It is therefore possible to use the key 10 to displace the lock tumblers 4 into the inner positions, thereby disengaging them from the recesses 15, and to then rotate the core 2 between the lock and unlock positions. It is, however, impossible to displace the core 2 beyond these positions into the antitheft position which is normally offset by a full 180° or more from the starting position of FIG. 3*a*. In fact the entire core can be turned over in the antitheft position so that it is impossible to get the core back into any other position without use of the special antitheft key 11.

As is apparent from FIG. 3*a* the actuation or control edges 8 and 9 of the tumblers 4 and 5 lie to opposite sides of a plane 18 bisecting the two recesses or grooves 15 and the tumblers 4 and 5 in their starting positions. Similarly as can be seen from FIGS. 6 and 7 the keys 10 and 11 have actuation formations or bitted edges 19 and 20 lying to opposite sides of a plane 21 bisecting these keys 10 and 11 and lying on the plane 18 when the keys 10 and 11 are inserted in the passage 2' and through the apertures 6 and 7. Obviously the control edges 8 and 9 are differently spaced from the respective ends of the respective tumblers 4 and 5, and the keys 10 and 11 are formed with appropriate bits that move into the inner positions in a manner well known in the art. The tumblers 4 and 5 can all be positioned so that they lie wholly within the cylinder defined by the outer surface of the core 2 on the axis A.

Thus the bits 19 of the lock key 10 will not be able to engage the control edges 9 of the tumblers 5 at all, and correspondingly the bits 20 of the key 11 will not be able to engage the control edges 8 of the tumblers 4. This allows the two keys 10 and 11 to be bitted totally differently. Both of the tumblers 4 and 5 in each of the guides 14 are urged in the same diametral direction by the respective spring 12 and 13. The lock tumblers 4 are formed with small protrusions 22 that can engage in slots or nothes 23 of the respective antitheft tumblers 5. These formations 22 and 23 are provided at the ends of tumblers 4 and 5 that are the leading ends in the diametral direction of displacement of the tumblers. As mentioned above, alternate pairs of tumblers 4 and 5 move in opposite diametral directions to foil picking of the lock.

It is therefore possible by means of the antitheft key 11 as shown in FIG. 2 to displace all of the antitheft tumblers 5 into the inner position in which they lie within the cylindrical surface defined by the surface of the core 2, and simultaneously to entrain the respective tumblers 4 into the inner positions also by means of the interengaging formations 22 and 23. The key 11 is therefore effective via the respective tumblers 5 and formations 22 and 23 on the tumblers 4, but does not itself directly contact them. With the key 11 in place as shown in FIGS. 2, 4 and 5, it is therefore possible to rotate the core 2 at will about the axis 2A. Normally a third antitheft position is provided to the other side of the lock position shown in FIG. 3*b*, so that the user must turn the key 11 through an almost entire revolution about the axis 2*a* to operate the antitheft mechanism described in the above-cited copending application.

Figure 8:
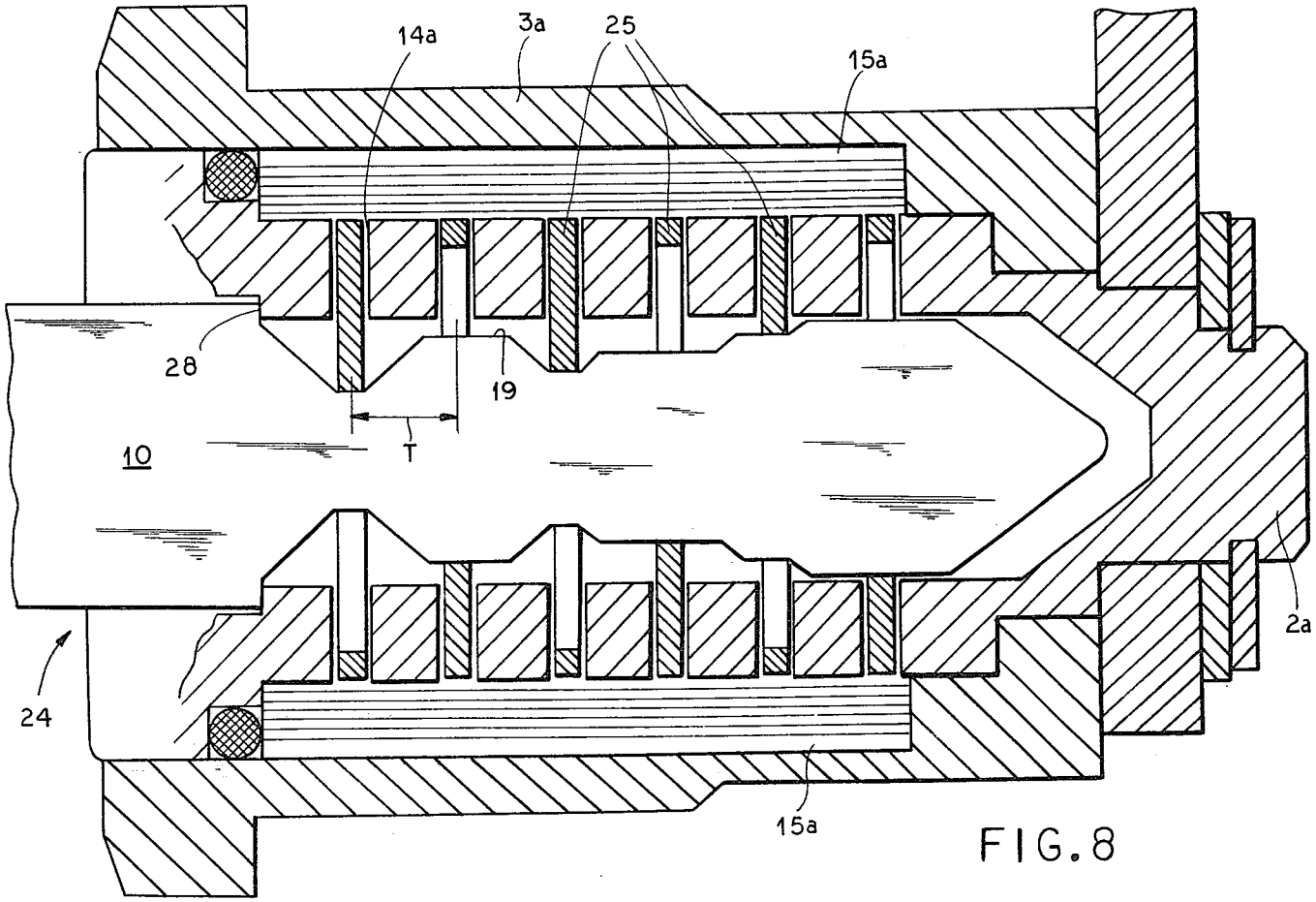
FIG. 8 is an axial section through a secondary lock, according to the instant invention, here a lock for a door other than the driver door, with the lock key in place.
Figure 9:
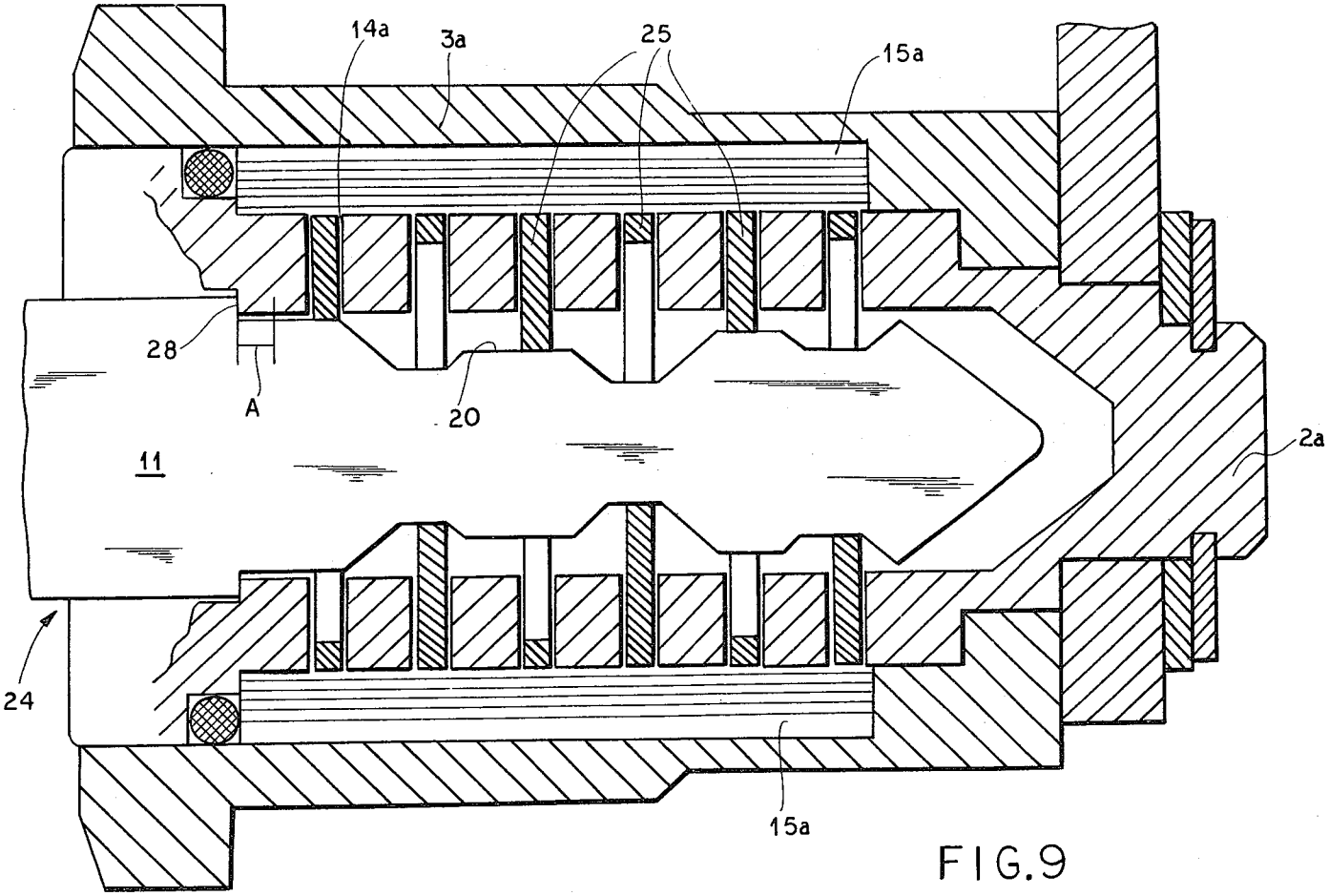
FIG. 9 is an axial section through the lock of FIG. 8 with the antitheft key in place.
Figure 10:
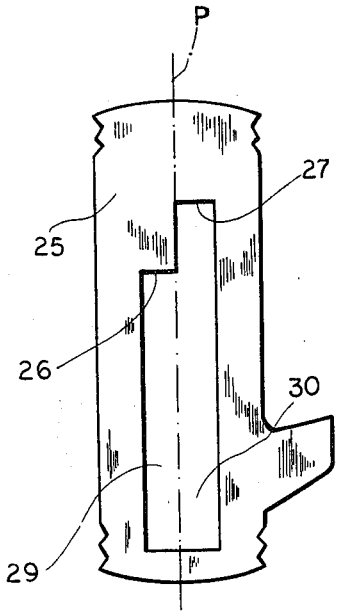
FIG. 10 is an end view of a double-use tumbler according to this invention.

FIGS. 8 and 9 show a secondary lock 24 of the type used on a door other than a driver's door and having a tubular housing 3*a* receiving a core 2*a*. The housing 3*a* is formed simply with a pair of longitudinally extending grooves 15*a* substantially identical to the grooves 15. No formations corresponding to the recesses or grooves 17 are, however, formed in the housing 3*a*. In addition the core 2*a* carries six double-duty tumblers 25 shown in further detail in FIG. 10, and radially displaceable in guides or passages 14*a* spaced apart by the distance T like the guides 14 of the core 2. Instead of having control edges such as shown at 8 and 9 in FIGS. 1–5, the double-duty plate tumblers 25 are subdivided at a diametral plane P into a lock region 26 and an antitheft region 27 respectively engageable with the bits or actuation formations 19 and 20 of the keys 10 and 11 as shown in end views of FIGS. 6 and 7. These regions 26 and 27 are not aligned with one another, the control edge being stepped between them at the plane P. Otherwise the tumblers 25 are spaced apart axially by the distance T.

The core 2 is formed with a key abutment 28 that allows the keys 10 and 11 to be inserted into them so that the respective formations 10 and 20 act on the respective regions 26 and 27. In this manner as is obvious by a comparison of FIGS. 8 and 9, it is possible for both the lock key 10 and the antitheft key 11 to operate the secondary locks, even though these keys 10 and 11 are differently bitted. The aperture in the plate tumblers 25 is clear at regions 29 and 30 diametrally opposite the regions 26 and 27, respectively, to allow free passage of the correspondingly bitted opposite edge of the keys 10 and 11 as is obvious by comparison of FIGS. 6 and 7. Each of these plates 25 is urged diametrally in one direction by the respective spring 12 and is displaced in the opposite direction by one of the bitted edges 19 or 20 of the key 10 or 11, so that the key's opposite bitted edge is ineffective. Nonetheless the keys 10 and 11 are symmetrically double-bitted so that they not only can be fitted into the passage either right side up or upside down, but so that also the springs 12 can urge alternate tumblers 25 in opposite directions. Thus picking of the lock becomes extremely difficult, as the core 2*a* is held in the housing 3*a* at two diametrally opposite locations. The core 2*a* has an abutment 28 appropriately positioned so that the bitted edges 19 and 20, whose bits are spaced apart by the distance T, will be appropriately positioned adjacent the respective tumblers 25.

Figure 11:
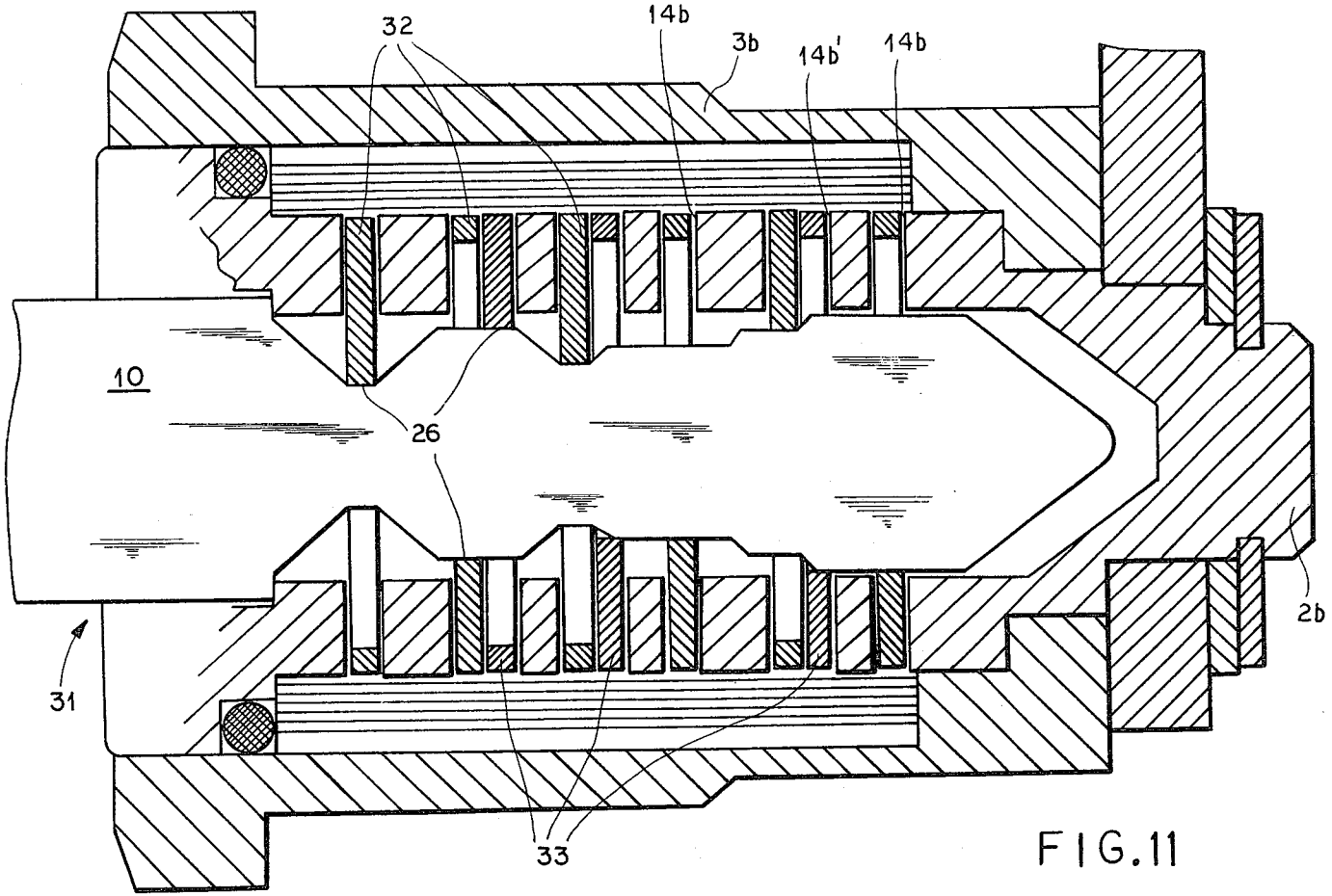
FIG. 11 is an axial section through another secondary lock according to this invention, here the ignition lock, with the lock key in place.
Figure 12:
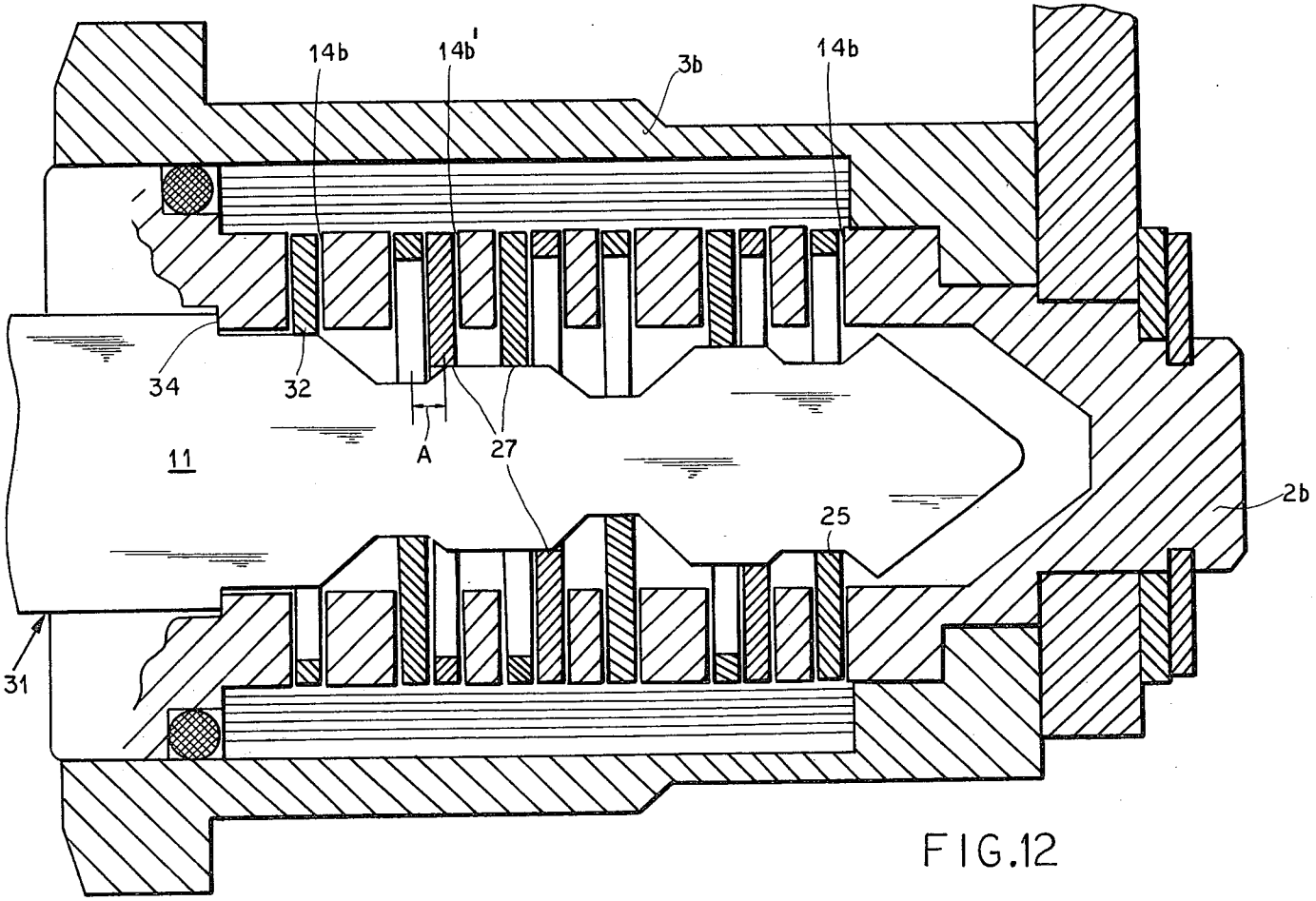
FIG. 12 is an identical section through the same lock as FIG. 11 but with the antitheft key in place.

In FIGS. 11 and 12 an ignition lock 31 is shown having a housing 3*b* identical to the housing 3*a* and a core 2*b* similar to the cores 2 and 2*a*, but having six transverse passages 14*b* and 14*b'*, the former each receiving a single tumbler 32 or 33 and the latter a tumbler 32 and a tumbler 33. The tumblers 32 and 33 are substantially identical to the tumblers 25 shown in FIG. 10, but where they are paired in the passages 14*b'* they are biased by the respective springs 12 in opposite directions. They each have control edges subdivided into regions 26 that coact with the bitting 19 of the key 10 and region 27 that can coact with the bitting 10 of the key 11, so that these tumblers 32 and 33 can be displaced into the inner position shown in FIG. 11 for rotation of the core 2*b* in the housing 3*b*. Once again the core 2*b* is provided with an abutment 34 spaced an appropriate distance from the first transverse passage 14*b* to position the bitted edges 19 and 20 of the keys 10 and 11 at the appropriate positions. Such a lock, with nine separate tumblers 32 and 33, is an extremely hard lock to pick and is virtually impossible to force. Thus the critical ignition lock 31 will be substantially harder to overcome than the door locks 24.

With the system according to the instant invention it is therefore possible for the owner of a vehicle to retain the special antitheft key 11 by means of which it is possible to place all of the door locks into the antitheft position described in our above-cited copending application. At the same time this owner can give out ignition and door keys which operate the ignition and all of the door locks in the normal manner, so long as the door latches have not been placed in the antitheft position. Indeed the holder of such a key 10 need not even know that the vehicle has such antitheft protection, as the key 10 will resemble a standard key. Only by close comparison of the keys 10 and 11 will the difference become apparent.

We claim:

1. A lock assembly comprising:

a main lock having a main-lock housing formed with a main axially extending and inwardly open groove;

a main-lock core plug rotatable in said main housing about a main axis and forming an axially extending and open main passage;

pluralities of first and second main tumblers exposed at said main passage and diametrally displaceable therein between outer positions engaged in said main groove and inner positions disengaged therefrom; and means including formations in said housing cooperating with said main tumblers and defining for said plug in said housing a pair of end positions and an intermediate position therebetween for displacement of said plug between said end positions and through said intermediate position when all of said lock tumblers are in said inner positions and for displacement only between one of said end positions and said intermediate position when said first tumblers are in said inner positions but said second tumblers are in said outer positions;

a secondary lock having a tubular secondary-lock housing having an inner wall generally centered on a secondary axis and formed with an axially extending and inwardly open secondary groove;

a secondary core plug in said secondary housing having an outer surface closely radially juxtaposed with said inner wall and a central axially extending and open key-receiving secondary passage, said secondary plug being rotatable in said secondary housing about said secondary axis; and a plurality of axially spaced secondary tumblers exposed at said secondary passage in said secondary plug and diametrally displaceable therein along a diametral plane between outer positions projecting radially beyond said outer surface and inner positions lying radially within said outer surface, said secondary tumblers being displaceable into said outer positions when radially aligned with said secondary groove and said secondary core being blocked from rotating in said secondary housing when said secondary tumblers are engaged in said outer positions in said secondary groove, said secondary tumblers having respective control edges subdivided at said plane into first edge regions and second edge regions, at least some of said first edge regions being out of line with the respective second edge regions; and first and second differently bitted keys engageable in said passages with the respective control regions and tumblers, said first key having first bits engageable only with said first regions and tumblers when said first key is in the respective passage and said second key having second bits engageable only with said second regions and tumblers when said second key is in the respective passage, said bits, first and second tumblers, and regions being so constructed and adapted that when either of said keys is fully engaged in the respective passage with the respective bits engaging the respective regions and tumblers the respective tumblers are in said inner positions.

2. A lock assembly comprising:

a tubular main-lock housing having an inner wall generally centered on a main-lock axis;

a main-lock core plug in said housing having an outer surface closely juxtaposed radially with said inner wall of said main housing and a central axially extending key-receiving passage, said main plug being rotatable in said main housing about said main axis between a pair of angularly offset end positions and through an intermediate position between said end positions;

pluralities of first and second tumblers exposed at said passage of said main plug and diametrally displaceable therein between outer positions projecting radially beyond said outer surface of said main plug and inner positions lying radially within said outer surface of said main plug;

at least one inwardly open first recess formed in said inner wall of said main housing in radial alignment with said first tumblers only in one of said end positions of said main plug, said first tumblers being engageable in said first recess when in said outer positions and thereby preventing angular displacement of said main plug from said one end position;

at least one inwardly open second recess formed in said inner wall of said main housing in radial alignment with said second tumblers only in and between said one end position and said intermediate position of said plug, said second tumblers engaging in said second recess only in and between said one end position and said intermediate position when in said outer positions and thereby preventing angular displacement of said plug into the other end position with said second tumblers in said outer positions; and first and second differently bitted keys engageable in said passage with said tumblers, said first key having first bits operatively engageable only with said first tumblers when said first key is in said passge and said second key having second bits operatively engageable only with said second tumblers when said second key is in said passage, said bits and first and second tumblers being so constructed and adapted that when either of said keys is fully engaged in said passage with the respective bits engaging the respective tumblers same are in said inner positions.

3. The lock assembly defined in claim 1 wherein said core plug is formed with a plurality of axially spaced transverse passages intersecting said key-receiving passage and each receiving at least one respective tumbler.

4. The lock assembly defined in claim 3 wherein each transverse passage receives only one of said tumblers.

5. The lock assembly defined in claim 3 wherein at least some of said transverse passages receive a pair of said tumblers.

6. The lock assembly defined in claim 5 wherein the tumblers of each pair are radially oppositely displaceable into the respective outer positions.

7. The lock assembly defined in claim 6, further comprising springs urging said tumblers into said outer positions.

8. The lock assembly defined in claim 7 wherein said transverse passages are generally axially equispaced, the transverse passages having pairs of said tumblers being axially longer than the transverse passages only having one tumbler.

9. The lock assembly defined in claim 1 wherein said control edges are stepped at said plane between the respective regions.

10. The lock assembly defined in claim 1 wherein each of said keys on full insertion into said passage is engageable with all of said control edges.

* * * * *